US006154920A

United States Patent [19]

Petrole et al.

[11] Patent Number: 6,154,920

[45] Date of Patent: Dec. 5, 2000

[54] SWEEPER APPARATUS

[76] Inventors: William G. Petrole, 1 Zelhollow Rd.; Brian T. Burke, Rte. 2, Box 455, both of Marietta, Ohio 45750

[21] Appl. No.: 09/256,870

[22] Filed: Feb. 24, 1999

[51] Int. Cl.[7] ..... A47L 9/04

[52] U.S. Cl. ..... 15/349; 15/83

[58] Field of Search ..... 15/348, 349, 83

[56] References Cited

U.S. PATENT DOCUMENTS

| | | | |
|---|---|---|---|
| 27,839 | 4/1860 | Smith | 15/83 |
| 485,577 | 11/1892 | Ethridge | 15/349 X |
| 926,723 | 7/1909 | Briggs . | |
| 982,570 | 1/1911 | Brooks . | |
| 1,069,773 | 8/1913 | Duthie . | |
| 1,085,676 | 2/1914 | Finch | 15/349 |
| 1,164,098 | 12/1915 | Kinsey, Jr. . | |
| 1,328,521 | 1/1920 | Jemmison | 15/348 X |
| 1,514,949 | 11/1924 | Bell et al. . | |
| 1,585,768 | 5/1926 | Clayton et al. . | |
| 2,448,328 | 8/1948 | Russell | 15/83 |
| 2,739,340 | 3/1956 | Blydenburgh et al. . | |
| 3,112,593 | 12/1963 | Ronning | 15/83 X |
| 3,189,042 | 6/1965 | Kerley, Jr. et al. . | |
| 3,503,419 | 3/1970 | Poinsot . | |
| 3,670,359 | 6/1972 | Gutbrod . | |
| 3,747,156 | 7/1973 | Carlson et al. | 15/349 |
| 3,824,645 | 7/1974 | Krier et al. . | |
| 3,938,212 | 2/1976 | Krier et al. . | |
| 3,942,218 | 3/1976 | Krier et al. . | |
| 4,120,311 | 10/1978 | Durham et al. | 15/83 X |
| 4,335,742 | 6/1982 | Jacyno . | |
| 4,393,537 | 7/1983 | Reprogle et al. . | |
| 4,398,557 | 8/1983 | Dugge . | |
| 4,741,072 | 5/1988 | Wilkerson . | |
| 4,771,504 | 9/1988 | VanGinhoven et al. | 15/349 X |
| 4,823,423 | 4/1989 | Schmid et al. . | |
| 4,930,530 | 6/1990 | Crego et al. . | |
| 5,617,893 | 4/1997 | Webster . | |
| 5,784,756 | 7/1998 | Slocum et al. | 15/348 |

OTHER PUBLICATIONS

"Schwarze Purchases Enviro Whirl Technology," article from *American Sweeper,* pp. 23–25.

Advertising brochure for Tennant 6400 Power Sweeper.

Article for AAR Powerboss, inc.'s PowerBoss® Sweepers.

Website for Tennant sweepers copyright Oct. 1997.

Advertising brochure for Tennant sweepers.

Advertising brochure for Tennant 385 power sweeper.

Advertising brochure for Tennant Model Nos. 355, 385 and 830 power sweeper specifications.

Advertising brochure for Pullman–Holt Gansow sweepers.

Advertising brochure for Nilfisk–Advance, Inc.'s rider sweepers.

Advertising brochure for PowerBoss sweepers.

*Primary Examiner*—Chris K. Moore

*Attorney, Agent, or Firm*—Wallenstein & Wagner, Ltd.

[57] ABSTRACT

A sweeper apparatus is disclosed for effectively and efficiently sweeping debris from a floor surface with a minimal amount of dust being generated outside of the apparatus. The sweeper apparatus includes a sweeper head assembly having a containment housing, a sweeper brush, an auger brush, and a vacuum intake head. The sweeper brush and the auger brush are rotatably mounted within the containment housing. The sweeper brush gravitationally rests upon the ground surface and provides for urging debris into the housing and towards the auger brush. The apparatus includes a vacuum source including a positive displacement vacuum capable of drawing vacuum through the sweeper head and drawing debris into a collection chamber. The apparatus of the present invention further includes an adjustable relief valve associated with the vacuum assembly. The relief valve has a sealing member and a pneumatic chamber adapted to bias the sealing member against a wall of the assembly to thereby seal an opening. The relief valve being adjustable by regulating the pneumatic pressure in the chamber, thereby adjusting the bias pressure of the sealing member against the wall.

10 Claims, 3 Drawing Sheets

SWEEPER APPARATUS

DESCRIPTION

1. Technical Field

The present invention relates generally to a vehicle mounted vacuum and sweeper apparatus for cleaning ground surfaces, such as a paved thoroughfare or floor, and in particular to a vehicle mounted sweeper apparatus using both a positive displacement vacuum source and a plurality of brushes for cleaning the ground surface.

2. Background of the Invention

Conventional pavement sweepers use a fan or paddle wheel vacuum source along with one or more brushes to remove debris from a paved surface. However, the use of brushes and the ineffective application of vacuum results in these sweepers emitting an unacceptable amount of airborne dust particles and debris into the surrounding environment instead of depositing the waste material into a collection receptacle.

To suppress the dust, many conventional sweepers utilize a method of spraying liquid on the surface, such as water. One drawback to this type of unit is the need to provide liquid tanks for both clean and dirty cleaning solutions. Additionally, the use of liquid is undesirable for certain applications where debris could react with the liquid, making disposal of the liquid and debris mixture difficult, or potentially causing an environmental hazard, such as creating a risk of waste material contaminating water supply.

What is needed is a vehicle mounted sweeper that efficiently collects waste material, and without using liquid to suppress the amount of dust generated. As will be seen through the description and claims below, this need is resolved by the present invention.

SUMMARY OF THE INVENTION

The present invention provides a sweeper apparatus that effectively and efficiently sweeps debris from a ground surface and removes the debris into a collection receptacle with a minimal amount of dust being generated and released outside of the sweeper apparatus.

The present invention provides a sweeper head assembly mounted to a vehicle and having a containment housing, a sweeper brush, an auger brush, and a vacuum head. The sweeper brush and the auger brush are rotatably mounted within a chamber defined by the containment housing. The sweeper brush contacts and gravitationally rests upon the ground surface through below the containment housing and rotates in sweeping relation to the floor surface and urges debris onto a sweeper plate and toward the auger brush. The containment housing includes a debris inlet in fluid communication with the intake head wherein the auger brush pushes the debris into the inlet. It is further an object of the present invention to provide a vacuum assembly having a vacuum relief valve with a sealing member to cover an opening in the sidewall of the assembly. The relief valve has an adjustable pneumatic chamber urging the sealing member toward the wall with force that is adjustable by regulating pressure of air in a passageway in fluid communication with the pneumatic chamber.

DETAILED DESCRIPTION

Figure 1:
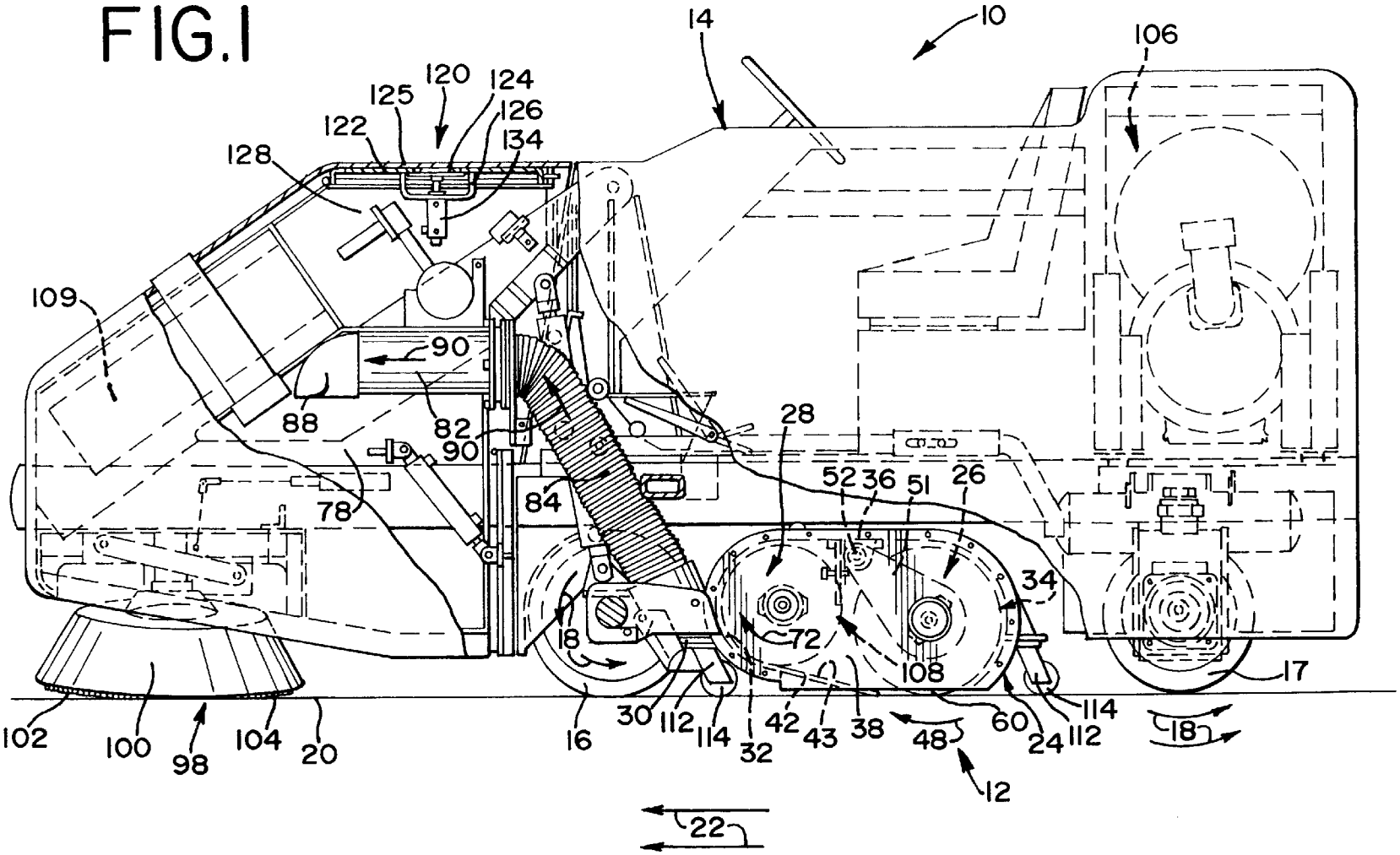
FIG. 1 is a partial section view of a motorized sweeper vehicle providing a positive displacement vacuum source and including a sweeper head assembly in accordance with the present invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Turning to the FIGURES, and particular FIG. 1, a sweeper apparatus 10 is depicted having a sweeper head assembly 12 mounted to a motorized vehicle 14 providing a positive displacement vacuum source through the sweeper head assembly 12. In the preferred embodiment, the motorized vehicle 14 is self-propelled by a conventional motor operably coupled to either a front drive wheel 16 or a rear drive wheel 17. Accordingly, rotation of the drive wheels 16, 17 in the direction of arrow 18 allows for the sweeper apparatus 10 to sweep a generally planar street or floor surface 20 with the apparatus 10 traveling in a direction of translation, depicted by arrow 22.

Figure 2:
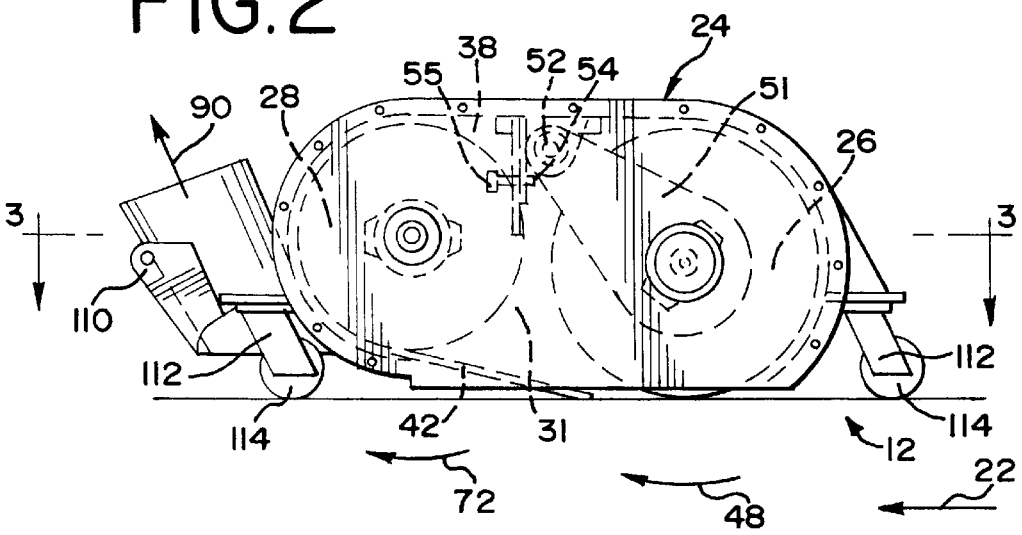
FIG. 2 is a side view, partial in phantom, of the sweeper head assembly depicted in FIG. 1.
Figure 4:
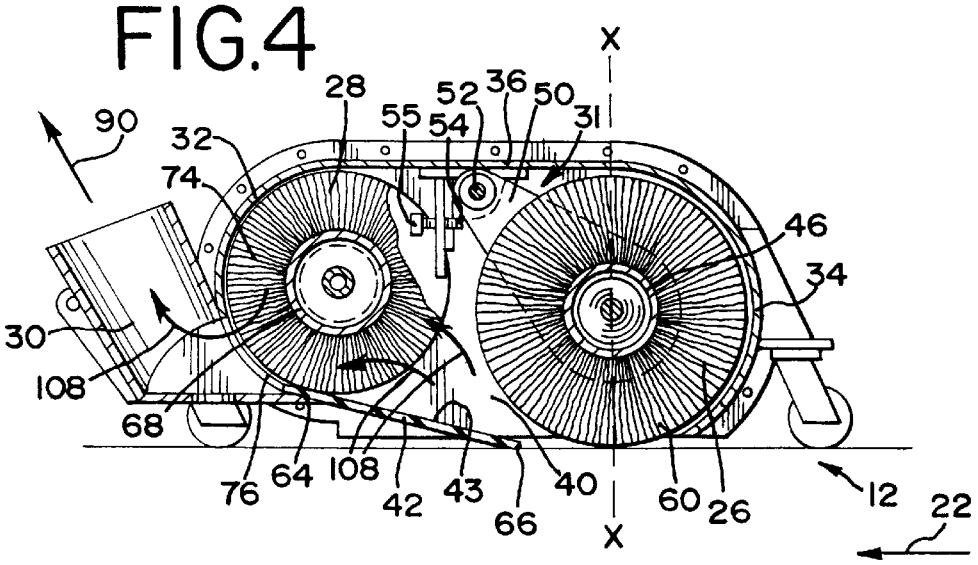
FIG. 4 is a cross-sectional view of the sweeper head assembly taken along plane 4—4 of FIG. 3.
Figure 5:
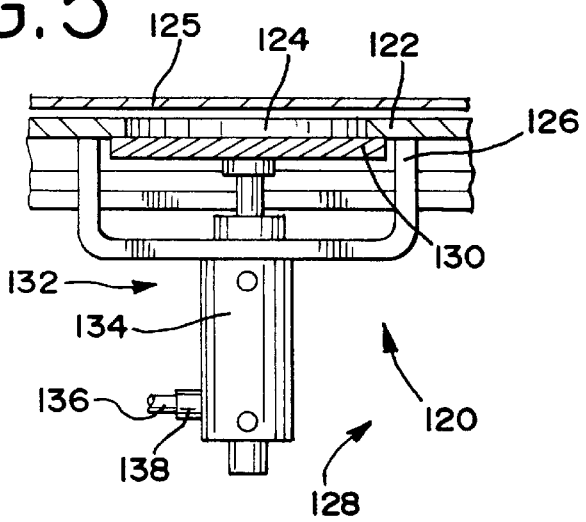
FIG. 5 is a partial sectional view of a portion of FIG. 1 depicting the vacuum relief valve of the present invention.
Figure 3:
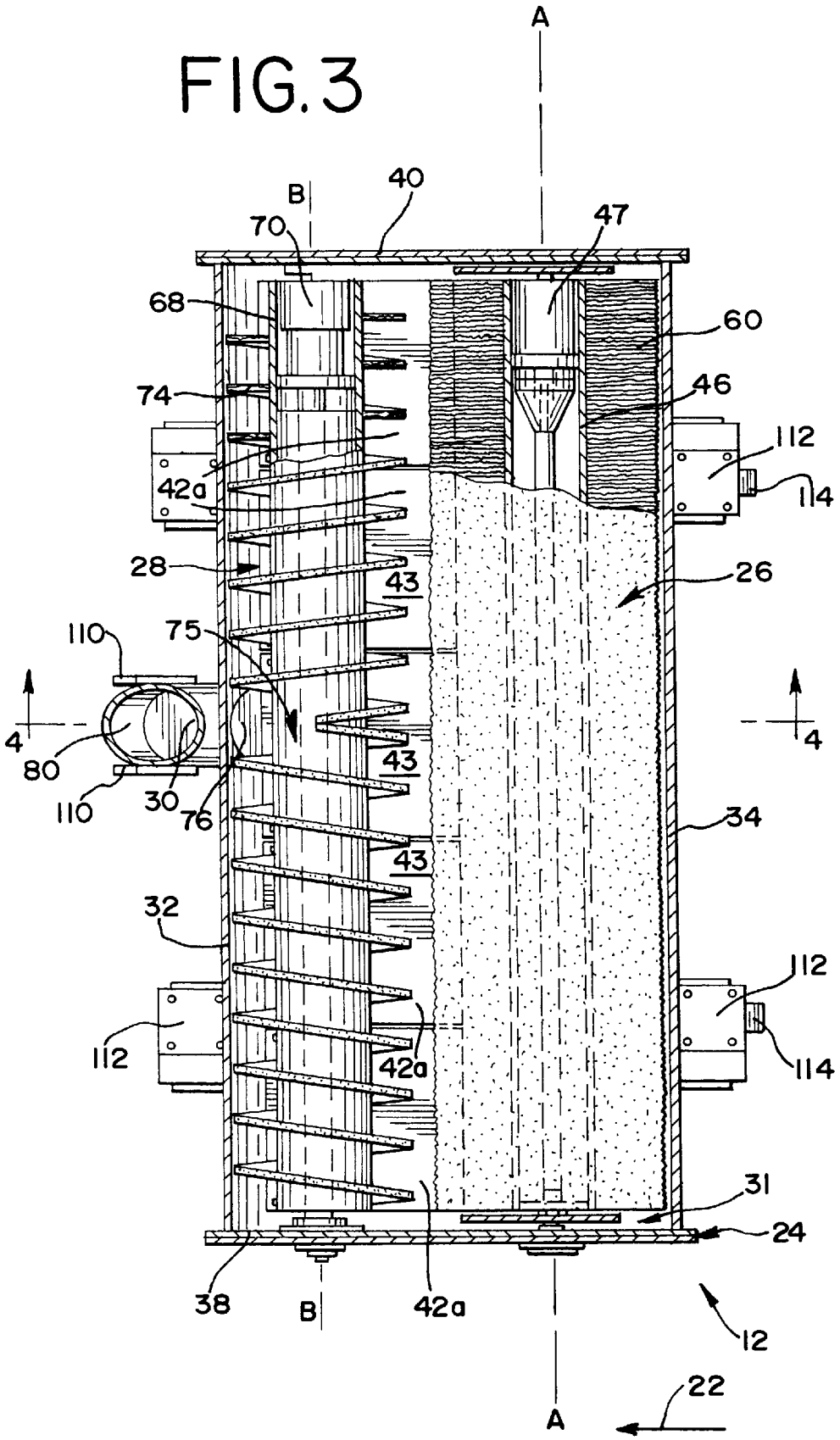
FIG. 3 is a partial cross-sectional view of the sweeper head assembly taken along plane 3—3 of FIG. 2.

Preferably, as shown by FIGS. 2–4, the sweeper head assembly 12 includes a containment housing 24, a primary sweeper brush 26, a secondary auger brush 28, and a vacuum head 30. The containment housing 24 defines a chamber 31 by an elongated front wall 32, an elongated back or rear wall 34, an upper or top wall 36 and a plurality of opposed side walls 38 and 40. A lower sweeper plate 42 is secured to the containment housing 24, thereby encasing a portion of the bottom of the housing 24 and being adapted to provide an inclined inner surface 43 providing a ramped surface for debris being urged forward by the brush 26, as is described further below.

The front wall 32 and back wall 34 of the housing 24 are preferably concave and adapted to generally follow the outer circumferential shape of the auger brush 28 and the sweeper brush 26, respectively. Also, the front wall 32 and back wall 34 are positioned generally opposite of each other with the upper wall 36 integrally attached between the front and back walls 32, 34. In the preferred embodiment, the front wall 32, rear wall 34 and upper wall 36 are all formed from a single sheet of steel, and are secured together with the side walls 38, 40 at the sides of the formed steel sheet.

The sweeper plate 42 of the containment housing 24 is integrally attached to the front wall 32 and extends toward the rear wall 34. As is explained further below, the sweeper plate 42 provides an inclined upper surface 43 adapted to provide a ramp for debris to pass between the sweeper brush 26 and the auger brush 28.

The sweeper brush 26 is mounted within the chamber 31 defined by the containment housing 24 and proximate to the concave rear wall 34. Moreover, a portion of the sweeper brush 26 extends below the containment housing 24 and engages the pavement surface 20. The sweeper brush 26 is preferably an elongated rotary brush, such as a cylindrical rotary brush. As best illustrated by FIG. 3, the sweeper brush 26 includes an outer cylindrical spindle 46 with a spindle drive assembly 47 mounted therein for rotating the spindle 46 about its axis A—A in a rotational direction, depicted by arrow 48 in FIG. 1, opposite the rotational direction 18 of the vehicle wheels 16, 17. Preferably, the spindle drive assembly 47 is a hydraulic-driven motor operably coupled to the spindle 46. Alternatively, the motor of the drive assembly may be electric, or by other means for mechanically driving the spindle 46 of the brush 26.

By mounting the drive assembly 47 within the spindle 46, bristles can be mounted along the entire width of the spindle 46 without having to provide for coupling the spindle 46 to an external drive motor at the end of the spindle 46, or by a conventional belt or chain drive. Therefore, because the drive assembly 47 is located inside the spindle 46, the effective area of surface 20 contacted by the sweeper brush 26 extend substantially the entire width of the housing 24, and thereby also substantially the entire width of the vehicle 14.

The longitudinal terminal ends of the sweeper brush 26 are operably attached to a pair of arms 50, 51 within the containment housing 24 having opposite ends pivotable upon a shaft 52. Preferably, the shaft 52 is mounted in fixed position within the containment housing 24 at a position allowing for the arms 50, 51 to suspend from end portions of the shaft 52, and to pull the sweeper brush 26 during movement of the vehicle 14 in the direction of translation 22. Accordingly, the sweeper brush 26 gravitationally drops into position, pivotally connected by the pivotable connection of the arms 50, 51 to the shaft 52, such that the brush 26 is pulled over large immoveable objects or uneven areas of the floor surface 20. Because the brush 26 is being pulled in the suspended position, the brush 26 is less likely to be damaged by being jammed into such obstacles, such as curb surfaces or large heavy objects. Further, because the brush 26 drops to the floor surface 20 by being suspended from the shaft 52, the weight of the brush 26 is applied against the floor surface 20 independent of the height of the housing 24. Therefore, the brush 26 is kept in contact with the floor surface 20, even though the height of the housing 24 may slightly vary as the housing 24 is moved along the floor surface 20 by attachment to casters 112, 114, as described further below.

At least one adjustment stop 54 is operably connected to the housing 24 to limit the drop of the brush 26. In the preferred embodiment, a stop 54 is provided as a pair of threaded bolts 55, each bolt 55 being proximate to each respective support arm 50, 51. The position of the stop 54, provided by adjustment of the bolts 55 relative to the support arms 50, 51 is user adjustable for limiting the gravitational drop of the sweeper brush 26 to prevent the brush 26 from contacting the auger brush 28 when the assembly 12 is lifted from the floor 20, such as when it is not in use for sweeping the floor 20. In the preferred embodiment, the stop 54 does not interfere with the gravitational drop of the brush 26 on the floor surface 20, and instead acts as a safeguard solely to prevent contact of the brush 26 with the auger brush 28.

Extending generally radially outward from spindle 46 are a plurality of bristles 60 wherein, as indicated previously, the distal ends of some bristles extend from the bottom opening of the containment housing 24 and contact the street or floor surface 20. Accordingly, rotation of the sweeper brush 26 in the direction of arrow 48 causes the bristles 60 to sweep the street or floor surface 20 in a forward direction relative to the direction of translation 22. Consequently, the forward sweeping action of the sweeper brush 26 urges debris lying on surface 20 to be propelled in a generally forward and upwards direction toward the sweeper plate 42 and the auger brush 28 mounted within the containment housing 24.

As indicated above, mounted between the sweeper brush 26 and the auger brush 28 is a sweeper plate 42 having an inclined upper surface 43 adapted to provide a ramp positioned between the sweeper brush 26 and the auger brush 28. This arrangement of the sweeper plate 42 is thereby adapted to provide an upper surface 43 for deflecting debris toward the auger brush 28 when swept forward by the sweeper brush 26. The sweeper plate 42 has proximal portion 64 and a distal longitudinal edge 66 separated by the inclined upper surface 43. The proximal portion 64 is integrally attached to the front wall 32 of the containment housing 24, preferably in a location of the front wall generally below the auger brush 28. The distal longitudinal edge 66 is located in front of the sweeper brush 26 relative to the direction of translation 22, and is adjacent the floor surface 20.

The distal edge 66 of the sweeper plate 42 is preferably positioned immediately adjacent to or in contact with the floor surface 20. Also, the distal edge 66 preferably is positioned in the range of about 3 to 5 inches in front of the central horizontal line X—X of the sweeper brush 26 defining the lower-most portion of the bristles 60 in contact with the floor surface 20. The sweeper plate 42 is preferably formed of flexible sheet stock material, such as rubber, plastic or metal plate. Alternatively, the sweeper plate 42 may be formed of a linear brush, formed of one or more rows of bristles arranged along the width of the housing 24.

Further, in the preferred embodiment, the sweeper plate 42 is comprised of a plurality of generally co-aligned plate segments 42*a*, adapted to provide a sweeper plate 42 that spans the entire width of the brush 26 with independently mounted plate segments 42*a*. This feature provides a sweeper plate 42 that has segments 42*a* each adapted to passively lift over large debris or obstacles without causing lift of adjacent plate segments 42*a*. Accordingly, only a confined area of a segment 42*a*, or a few segments 42*a*, of the sweeper plate 42 is elevated when passed over large debris or uneven floor surface 20, thereby maintaining the remaining portions of the sweeper plate 42 in position for providing a ramping surface for debris. An example of a preferred embodiment is the sweeper plate 42 being comprised of a plurality of plate segments 42*a* approximately 12 inches in width along the brush 26 width.

As shown in FIGS. 2–4, the auger brush 28 is an elongated brush mounted within the chamber 31 of the containment housing 24 and proximate to the front wall 32. Preferably, the auger brush 28 is in sweeping engagement with both the proximal portion 64 of the sweeper plate 42 and the inner surface of the front wall 32. In the preferred embodiment, the height of the housing 24 under the auger brush 28 is in the range of 2 to 3 inches above the floor surface 20, thereby providing clearance for debris to pass thereunder.

Turning to FIGS. 2–4, the auger brush 28 includes an outer cylindrical spindle 68 having a spindle drive assembly 70 mounted therein for rotating the spindle about its longitudinal axis B—B in a rotational direction indicated by arrow 72 of FIG. 2. Preferably, the rotational direction 72 of the auger brush 28 is in the forward direction relative to the direction of translation 22. This feature provides rotation of the auger brush 28 to urge debris forward against the front wall 32 of the housing 24.

The longitudinal terminal ends of the auger brush 28 are operably attached to the containment housing 24. Moreover, the drive assembly 70 is of conventional construction and comprises a motor operably coupled to the spindle 68. In the preferred embodiment, the drive assembly 70 includes a hydraulic drive motor, preferably the same type of drive motor as the drive assembly 47 of the sweeper brush 26. Having the auger brush 28 and the sweeper brush 26 driven by hydraulic motors is a feature adapted to optionally provide the convenience of incorporating a single source of hydraulic pressure for driving the two motors. Further, in the preferred embodiment, the hydraulic motors are bot driven by a single hydraulic pump (not shown) that is preferably operated by a common gas or diesel engine.

Radially extending outward from the outer spindle 68 of the auger brush 28 are a plurality of bristle members 74 arranged in two helix patterns that are generally symmetrical to each other and converge at a central region 75, generally at the center of the spindle 68. The bristle members 74 provide a constant brushing of debris from the sweeper plate 42 toward the central region 75 of the spindle as the auger brush 28 is rotated about its longitudinal axis B—B. Accordingly, in operation, the auger brush 28 rotates in a manner to urge debris delivered from the sweeper brush 26 toward the central region 75 to a debris inlet 76 in the front wall 32 of the containment housing 24, wherein the inlet 76 is in fluid communication with the vacuum head 30. The debris inlet 76, via the vacuum head 30, also is in fluid communication with a debris collection chamber 78 within the vehicle 14. In particular, the vacuum head 30 is attached to a vacuum passageway 80 that includes a substantially horizontal rigid duct 82 extending into the collection chamber 78 and a generally vertical segment 84 in fluid communication between the duct 82 and the vacuum head 30. The generally vertical duct segment 84 is preferably formed of pliable or expandable tubing as shown in FIG. 1. The duct 82 has an open distal end 86 in fluid communication with the collection chamber 78 with a deflection member 88 attached thereto for deflecting debris passing from the duct 82 and into the chamber 78.

As shown in FIG. 1, the duct member 82 is generally parallel with a vertical axis passing through the vehicle 14 and the deflection member 88 consists of a downwardly directed spout attached to the distal end of the duct 82. Accordingly, debris traveling by vacuum force in vacuum direction 90 through the passageway 80 is drawn into the expandable segment 84 and into duct section 82. Debris then travels through the distal end of the duct 82 and into the deflection member 88, thereby the debris is deflected generally downward into the collection chamber 78.

In an embodiment, the expandable segment 84 consists of a flexible hose leading upward from the vacuum head 30. This expandable segment 84 has an adjustable length with a range of expansion and compression for flexibility when securing the sweeper head assembly to a positive displacement vacuum source within the vehicle 14.

Preferably, the assembly 10 includes at least one feeder broom 98. Each feeder broom 98 includes a ridge cap or shell 100, made of plastic or the like. The shell 100 encases the broom 98 along a major extent of the length of the bristles 102 of the broom 98. Accordingly, only the distal ends 104 of the bristles 102 project from the shell 100 and contact the floor surface 20. This feature provides encasement of the feeder broom 98, thereby restricting dust emitted by the broom 98, and providing a deflection surface for the debris swept by the broom 98 such that the debris is deposited under the vehicle 14 in front of the sweeper brush 26.

The assembly 10 includes a vacuum apparatus 106, preferably a positive displacement vacuum apparatus. This type of vacuum apparatus provides a vacuum source adapted to provide relatively high vacuum pressure, and being capable of drawing dust through the sweeper head assembly 12 and draw debris through the passageway 80 from the debris inlet 76. Accordingly, as shown in FIG. 4, the sweeper head assembly 12 includes a vacuum path 108 that is drawn through the sweeper brush 26, and through the area between the sweeper brush 26 and the sweeper plate 42. The path 106 of the vacuum is then drawn through the area of the housing 14 containing the auger brush 28. Because the auger brush 28 is comprised of bristles 74, the vacuum force is drawn through the auger brush 28, a feature that is not readily attained when employing a conventional type of auger made of steel. The vacuum path thereafter includes the debris inlet 76, the passageway 80, the collection chamber 78, and a conventional type of filter assembly 109.

The sweeper head assembly 12 further includes a positioning apparatus having a brace or yoke member 110 adapted to secure the sweeper head assembly to the vehicle 14. Preferably, the positioning apparatus also includes a plurality of depending caster members 112, each with a rotational wheel 114 engaged upon the floor surface 20. In an embodiment, the brace member(s) 110 and the rotational wheel(s) 114 are secured to the containment housing 24 such that the housing is secured to the vehicle 14 in the desired position above the floor surface 20, and the sweeper brush 26 gravitationally rests on the floor surface 20. In the event the assembly 12 is lifted to a non-use position, or the rear of the housing 24 is drastically raised due to raised floor surface 20 at the rear caster 112, the brush 26 is prevented from contacting the auger brush 28 by the stop 54 in combination with arms 50, 51. In particular, in the case of the stop 54 comprising an adjustable bolt 55 the distal ends of the bolts 55 are adjusted to abut against the arms 50,51 such that the brush 26 freely drops to and rests upon the floor 20, but the brush 26 is confined from dropping to the point of contacting the auger brush 28.

Turning to FIG. 1, it is preferred that a side rail bumper or guard 116 be positioned about the outer periphery of the vehicle 14 to protect both the vehicle 14 and any obstructions it may inadvertently strike. It is preferred that the bumper 116 consist of a polyvinyl chloride material (PVC) to prevent the bumper from marring the surface of a stricken obstruction by leaving a black swipe mark.

A vacuum relief valve 120 is provided in the assembly 10, preferably in a wall 122 associated with the collection chamber 76 at a position of an opening 124 in the wall 122. A cover wall 125 is optionally provided over the wall 122 and the opening 124. Preferably, the cover wall 125 is made of sheet stock materials, such as fiberglass, sheet steel or plastic, and a space is provided between the cover wall 125 and the opening 124 in the wall 122. The relief valve 120 is secured to the wall 122 by a brace member 126, preferably a cup-shaped or U-shaped brace 126 that extends into the interior 128 of the vacuum chamber from the wall 122. The relief valve 120 has a sealing member 130 and a biasing means 132 that includes a pneumatic chamber 134. The valve 120 has a pneumatic pressure source in fluid communication with the chamber 134 through an air passageway 136 connected at a fitting 138 on the chamber 134. The valve assembly 120 preferably has a means for adjusting the pneumatic pressure, such as by an adjustable pressure regulator valve or the like associated with the passageway 136. The adjustable pressure regulator (not shown) is preferably a common type pressure regulator available in the market. Further, in the preferred embodiment, the pneumatic pressure source is a pneumatic pump that is operated by the gas or diesel engine that operates the hydraulic pump adapted to power the motors of the brush 26 and the auger brush 28.

In operation, the biasing means 132 forces the sealing member 130 against the wall 122, thereby covering the opening 124. In the preferred embodiment, the biasing means 132 forces the sealing member 130 by way of the pneumatic chamber 134 being leveraged against the brace 126 member and pushing the sealing member 130 away from the brace member 126. Because the bias pressure of the pneumatic chamber 134 is adjustable by adjustment of the air pressure in the passageway 136 by the pressure regulator, the user may modify the biasing force of the sealing member 130 against the wall 122. When the vacuum apparatus 106 is operated, causing vacuum force to be drawn through the assembly 10, the relief valve 120 safeguards against excess vacuum force such as when a passageway of the vacuum assembly becomes clogged or blocked. When the vacuum force becomes excessive, and elevates to the level of force that exceeds the biasing force of the pneumatic chamber 134, the sealing member 130 is drawn into the interior 128 and away from the wall 122 to thereby expose the opening 124 and allow relief of the vacuum pressure in the assembly 10.

The method of the present invention includes the steps of sweeping and collecting debris from a ground surface 20 into a collection chamber 78 by utilizing a sweeper apparatus 10 having a sweeper head assembly 12. In particular, this method includes the step of providing a sweeper head assembly 12 with a sweeper brush 26 in contact with the floor surface 20, sweeping the floor surface 20 in a forward direction by rotating the sweeper brush 26 clockwise while moving the assembly 12 leftward to urge debris from the floor surface 20 onto the upper inclined surface 43 of the sweeper plate 42, and toward the auger brush 28. The method further includes the step of sweeping the debris within the housing chamber 31 into a debris inlet 76 by rotating an auger brush 28 in the same direction as the sweeper brush 26. The debris received by inlet 76 is drawn into a vacuum passageway 80 and propelled into the collection chamber 78 by the vacuum air stream.

It should be understood that the invention may be embodied in other specific forms without departing from the spirit or central characteristics thereof. The present example and embodiment, therefore, are to be considered in all respects as illustrative and not restrictive, and the invention is not to be limited to the details given herein. Therefore, the scope of patent protection is only limited by the scope of the accompanying claims.

What is claimed is:

1. A sweeper assembly for a motorized vehicle adapted for operationally moving in a direction of translation over a floor surface, the sweeper assembly comprising:

a containment housing having a lower wall and defining a chamber having a debris inlet:

a sweeper brush for contacting the floor surface and displacing debris from the floor surface, the sweeper brush being an elongated rotary brush having a central rotational axis disposed transversely in the housing, said sweeper brush operationally sweeping the floor surface in the direction of translation for forward rotation about said central rotational axis, said sweeper brush thereby pushing debris from the floor surface forward into a receiving area within said housing, said lower wall being located forward from the sweeper brush and disposed above the floor surface;

an auger brush operationally sweeping displaced debris deposited in the receiving area toward the debris inlet, the auger brush being elongated and having a central rotational axis disposed transversely in the housing above at least a portion of said lower wall and having brush members extending in a helix pattern; and a vacuum source in communication with a vacuum passageway operably coupled to said debris inlet.

2. The sweeper assembly of claim 1, wherein said lower wall includes a rear edge facing said sweeper brush, the rear edge being positioned above the floor surface and below said auger brush.

3. The sweeper assembly of claim 1, wherein the vacuum source is a positive displacement vacuum assembly.

4. The sweeper assembly of claim 1, wherein the lower wall comprises an inclined surface passing between a first end of an edge portion located proximal to said sweeper brush and a second end located below at least a portion of the auger brush.

5. The sweeper assembly of claim 1, wherein the sweeper brush is suspended from a fixed axis of rotation located above the sweeper brush, thereby allowing the sweeper brush to gravitationally rest on the floor surface.

6. The sweeper assembly of claim 5, wherein said sweeper brush is suspended from said fixed axis by at least one arm.

7. A sweeper assembly mounted to a motorized vehicle operationally moving in a direction of translation for removing debris from a floor surface, the sweeper assembly comprising:

a sweeper head assembly having a containment housing;

a sweeper brush for contacting the floor surface and displacing debris from the floor surface, the sweeper brush being an elongated rotary brush having a central rotational axis disposed transversely in the containment housing relative to the direction of translation and having brush members urging debris from the floor surface in a sweeping direction forward from the sweeper brush onto an inclined sweeper plate leading to a containment housing, the sweeper brush being suspended within said housing from a fixed axis to gravitationally freely rest upon said floor surface;

a means for urging debris from said receiving area toward a debris inlet within said containment housing including a spiral auger brush having brush members arranged in a converging helical pattern to urge debris from the sweeper plate to a debris inlet of a vacuum passageway adapted to draw the debris through the passageway into a collection chamber.

8. The sweeper assembly of claim 7, wherein the sweeper brush is disposed within the housing and operationally sweeps the floor surface in the direction of translation, said spiral auger brush and the sweeper plate is positioned forward of said sweeper brush relative to the direction of translation.

9. The sweeper assembly of claim 7, wherein said auger brush rotates about a second axis of rotation in a rotational direction the same as rotational direction of said sweeper brush.

10. The sweeper assembly of claim 7, wherein the sweeper brush gravitational rests on the floor surface and is suspended from a fixed axis by at least one pivot arm permitting a gravitational drop of said sweeper brush.

* * * * *